US008807110B2

(12) United States Patent
Smolik et al.

(10) Patent No.: US 8,807,110 B2
(45) Date of Patent: Aug. 19, 2014

(54) SYSTEM AND METHOD FOR SAMPLING FLUID FROM PISTON TOP LAND CREVICE OF PISTON ENGINE

(71) Applicants: Mitchel A. Smolik, Castroville, TX (US); Dustin B. Kramer, Helotes, TX (US); Timothy L. Haby, Rio Medina, TX (US)

(72) Inventors: Mitchel A. Smolik, Castroville, TX (US); Dustin B. Kramer, Helotes, TX (US); Timothy L. Haby, Rio Medina, TX (US)

(73) Assignee: Southwest Research Institute, San Antonio, TX (US)

( * ) Notice: Subject to any disclaimer, the term of this patent is extended or adjusted under 35 U.S.C. 154(b) by 120 days.

(21) Appl. No.: 13/718,392

(22) Filed: Dec. 18, 2012

(65) Prior Publication Data

US 2014/0165954 A1 Jun. 19, 2014

(51) Int. Cl.
*F02F 3/00* (2006.01)

(52) U.S. Cl.
CPC ..... *F02F 3/00* (2013.01)
USPC ... 123/193.6; 123/679; 123/703; 123/568.11; 73/865.6; 73/118.01; 73/866; 73/866.4; 73/61.62; 73/23.41; 422/78

(58) Field of Classification Search
USPC ..... 123/193.6, 679, 703, 568.11; 73/865.6, 73/118.01, 866, 866.4, 61.62, 23.41; 422/78
See application file for complete search history.

(56) References Cited

U.S. PATENT DOCUMENTS 4,903,648 A * 2/1990 Lassankse ..... 123/65 R
5,241,853 A * 9/1993 Tsuei et al. ..... 73/114.71
5,682,870 A * 11/1997 Motoyama ..... 123/703

* cited by examiner

*Primary Examiner* — Marguerite McMahon
*Assistant Examiner* — James Kim
(74) *Attorney, Agent, or Firm* — Chowhury & Georgakis, P.C.; Ann C. Livingston

(57) ABSTRACT

A system and method for sampling fluid from a top land piston crevice of a reciprocating piston engine. Access into the crevice is via a length of tubing inserted into a bore through the piston wall. Two valves, first a relief valve and then a piloted check valve, operate together to capture a sample of fluid from the crevice at a time just before TDC of the piston on its compression stroke. The sampled fluid flows from the check valve into a sample container. The valves further cooperate to close fluid communication from the crevice after a sample is taken, which allows the engine to operate normally.

11 Claims, 3 Drawing Sheets

SYSTEM AND METHOD FOR SAMPLING FLUID FROM PISTON TOP LAND CREVICE OF PISTON ENGINE

TECHNICAL FIELD OF THE INVENTION

This invention relates to testing internal combustion engines (and other piston engines), and more particularly to sampling fluid from the top land crevice of a piston.

BACKGROUND OF THE INVENTION

Crevices in the combustion chambers of piston engines are of interest to researchers for many reasons. As one example, combustion chamber crevices in internal combustion engines are significant contributors of hydrocarbon (HC) emissions. These crevices are identified as narrow regions of the combustion chamber into which the combustion flame does not reach. One such crevice is the gap between the piston and the cylinder wall. During the compression stroke, unburned charge is pushed into this crevice. The crevice is narrow enough to quench the flame front, leaving unburnt gases, so that during the power stroke, as the piston descends and the exhaust valve opens, these unburnt gases re-emerge in the exhaust.

To successfully achieve emissions goals, engine design and operation must account for the effects of combustion chamber crevices. To this end, efforts have been made to sample material in the piston crevices. Past sampling methods involve drawing the sample out through tubing connected to a hole through the piston near the piston rings. The tubing traverses the connecting rod and is carried by a specially designed linkage to the point where it exits the crankcase.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to sampling the fluid that collects in piston top land crevices of reciprocating engines. Interest in this topic has increased in recent years due to low speed pre-ignition problems common in high-BMEP gasoline engines. Past sampling methods have been unsuccessful in collecting and preserving a volume of fluid large enough to fully understand the composition of the crevice fluid.

The system and method described herein are particularly suitable for sampling piston crevices of internal combustion engines, but would be suitable for other piston engines. The method may be performed while the engine is in normal operation. The sampling system and method are particularly compatible with automotive engine architecture, but can be used with any piston engine of any thermodynamic cycle or fuel type.

Figure 1:
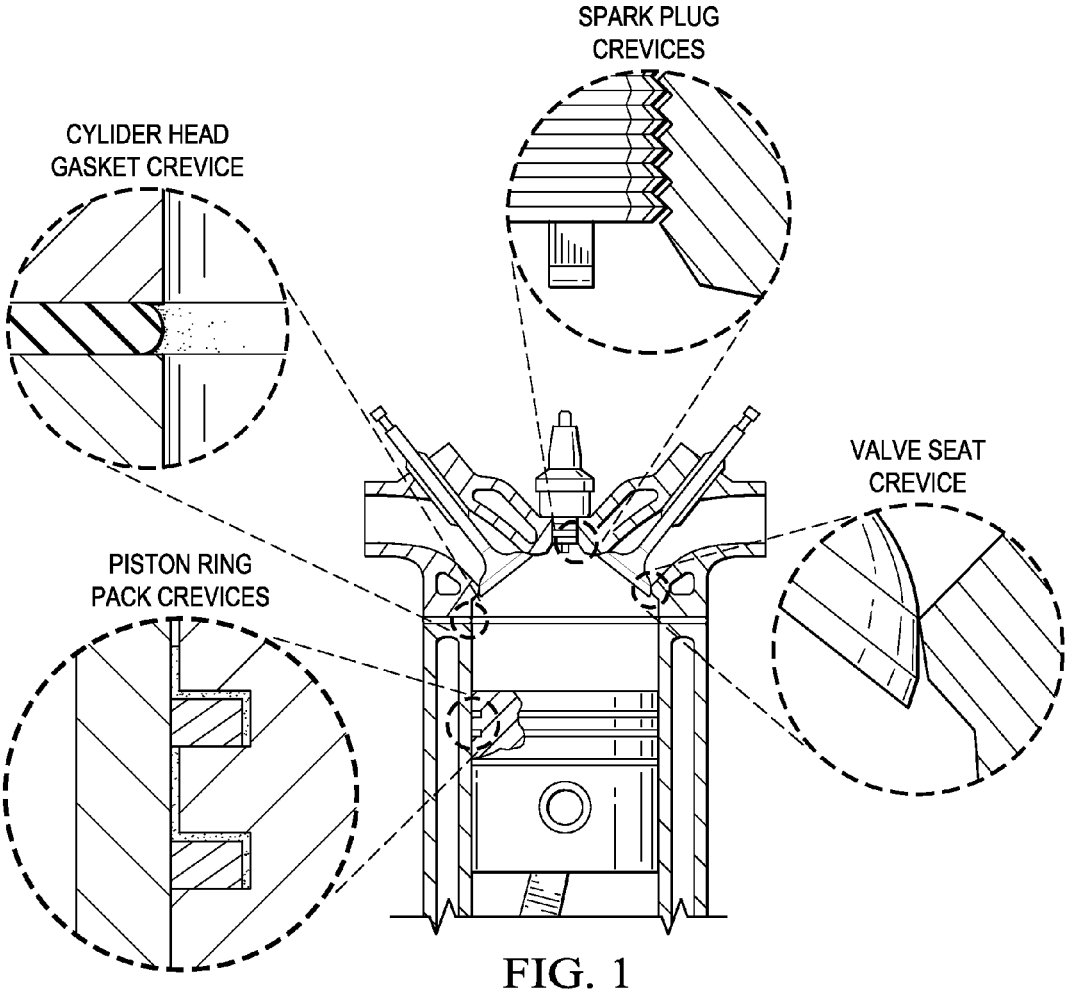
FIG. 1 illustrates various combustion chamber crevices.

FIG. 1 illustrates various combustion chamber crevices of an internal combustion engine. Specific examples of combustion chamber crevices are: the piston-ring-pack crevices, consisting of the top-land volume, the volume within the top-ring groove not occupied by the ring and the volume between the compression rings; the cylinder head gasket crevice; the valve seat crevice; and spark plug crevices.

Figure 2:
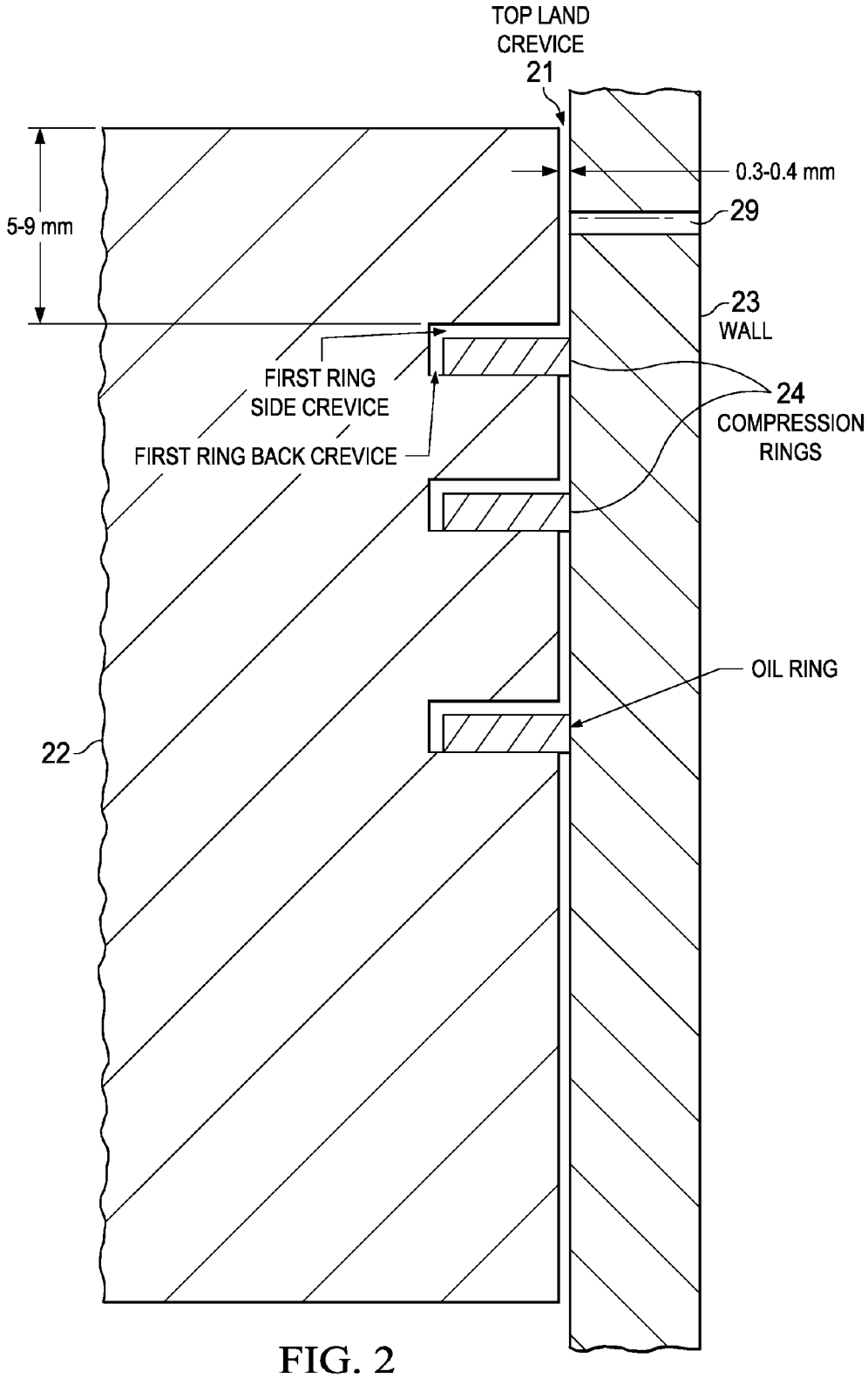
FIG. 2 illustrates the piston crevices of FIG. 1 in further detail.

FIG. 2 illustrates the top land piston crevice 21, which is the crevice sampled by the system and method described herein. It is an area between the piston 22 and the piston liner 23 above the top compression ring 24. Fluid sampled from the top land crevice 21 may also include fluid from the first ring side and back crevice areas. For purposes of this description, all sampled fluids are included in the term "top land crevice" fluids. FIG. 2 also illustrates typical dimensions (height and width) of the top land crevice in an automotive engine.

A passage 29 through the cylinder wall 23 provides access into the top land crevice 21 for the sampling device described below. The cylinder "wall" may be the engine block or engine block with a cylinder liner.

Figure 3:
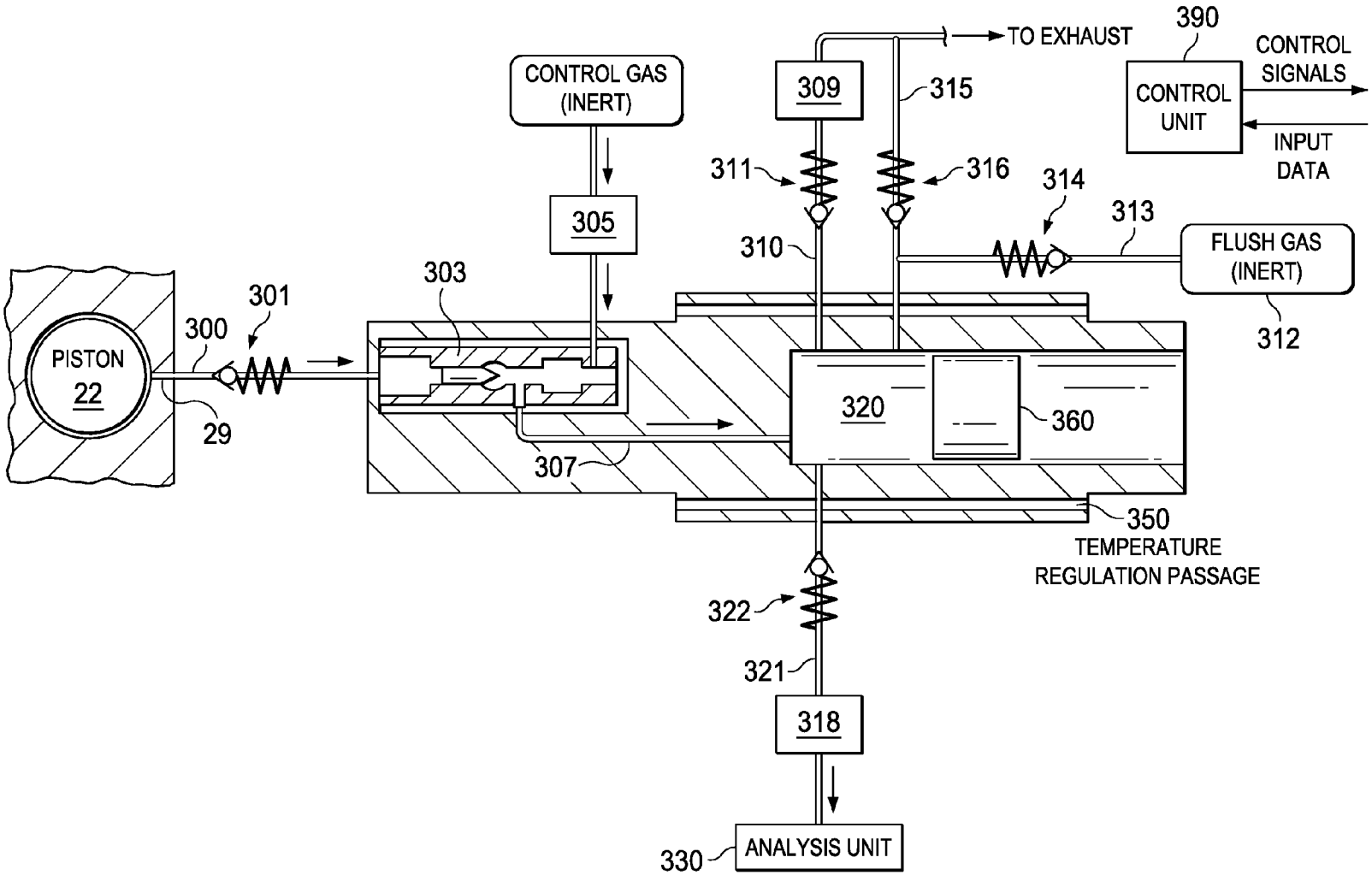
FIG. 3 illustrates a system for sampling the top land crevice of a piston.

FIG. 3 illustrates a piston top land crevice sampling system. It samples fluid from the top land crevice proximate to a piston 22 of a piston engine. For example, the piston top land crevice could be the crevice 21 shown in FIG. 2 in an internal combustion engine.

Referring to both FIGS. 2 and 3, the sampling system accesses the top land crevice 21 from outside the engine through a passage 29 through the cylinder wall (engine block and cylinder liner, if present). This passage 29 may be drilled and may be of very small size.

Tubing 300, which may be of any suitable material and is typically flexible, provides a leak-proof fluid communication into the passage. Tubing 300 first carries sampled fluid to a small in-line relief valve 301 near the combustion chamber. Relief valve 301 is set by spring preload to open near top-dead-center of the piston's compression stroke (TDCc).

Relief valve 301 determines the beginning of each sample event; its opening pressure is set to the compression pressure near TDC. It is positioned as close as possible to the cylinder, to limit additional clearance volume (and hence effect on cylinder performance) when not sampling. In other words, the length of tubing 300 between the crevice 21 and relief valve 301 is short.

Downstream from relief valve 301, connected to a second end of the tubing, is a piloted check valve (pilot-to-open) 303, which is used to stop the flow from the piston crevice 21 at some higher pressure. The pilot pressure supplied to the piloted check valve 303 is chosen so that the "micro-sample" flows into sample chamber 320 and valve 303 is closed before combustion causes a sharp rise in cylinder pressure. This avoids the introduction of large amounts of high temperature combustion gases into the closed volume of sample chamber 320. The pilot pressure is supplied with a control gas via a solenoid valve 305.

When valve 303 is open, the sampled fluid flows via sample line 307 into sample chamber 320. The micro-sample event is repeated a desired number of times until the pilot pressure to the piloted check valve 303 is reduced and the system stops sampling. Typically, the micro-sample event is repeated several times.

In this manner, a pilot pressure setting used to control the end of each micro-sample event. The pilot valve 303 closes off fluid flow from the piston crevice 21 when pilot pressure is removed.

Using these valves 301 and 303, a "micro-sample" event occurs near TDCc. Valve 301 opens at near TDCc to allow fluid flow from the top land crevice into tubing 300 toward valve 303. Valve 303 stops the fluid flow from the crevice at a predetermined pressure which corresponds to the time when combustion in the chamber causes a sharp rise in cylinder pressure. Otherwise, valve 303 is open and allows flow of the sampled fluid into the sample chamber.

After the piloted check valve 303 is closed, the engine is able to operate basically unaffected by the sampling system. Pressure builds in the space between the relief valve 301 and the piloted check valve 303 until the micro relief valve 301 does not open. The engine is then able to run as it would normally, with no appreciable clearance volume added, and hence with minimal effect on the engine's compression ratio.

After relief valve 301 closes after a combustion event, check valve 303 may be opened until it is closed during the next sample event as described above. After a number of micro samples are collected into sample chamber 320, the gas portion of the sample can be vented off using solenoid valve 309. The gas is vented from sample chamber 320 via a vent line 310 and a check valve 311.

An inert flush gas from a source 312 is used to fill the sample chamber 320 via a flush line 313 and check valve 314. This flush gas function provides sample purity.

The flush gas then drives the fluid sample from the sample chamber 320 a gas chromatograph 330 (or other analysis equipment) after trapped combustion gases are vented. The flush gas may also be used to purge sample chamber 320 prior to sampling via purge line 315 and relief valve 316.

When a desired number of samples have been collected, solenoid valve 313 is then opened to allow the collected fluid to be driven from sample chamber 320 to other analysis equipment 330 for analysis. The sampled fluid flows from sample chamber via an exit line 321 and check valve 322.

One or more temperature regulation passages 350 provide heat exchange from the sample chamber 320. Liquid in passage(s) 350 allows stabilization of temperature, and reduces any effect of temperature changes on the composition and viscosity of the sample.

In one embodiment, the sample chamber 320 is a closed end of a piston cylinder. A sample chamber piston 360 allows manual removal of material from sample chamber 320. It also provides for adjustment of sample chamber volume.

In other embodiments, sample chamber 320 may be replaced by any suitable volume for containing the sampled fluid prior to subsequent collection. These alternative volumes may or may not have means for venting or flushing. The sampled fluid (gas and/or liquid) may be collected and analyzed by various means.

Control unit 390 has appropriate hardware and programming for automating the above-described method. It sends control signals to valve 305 to control check valve 303, to valve 309 to control venting of gas, and to valve 318 to control delivery of sample fluid to analysis equipment.

An additional feature of the above-described system is that it resides mainly outside of the engine and has no parts attached to the crank-train. It is capable of taking several micro-samples before sending a larger sample for analysis.

Various methods of sampling fluid from a top land piston crevice may be performed using a bore into which tubing is inserted and using a relief valve and check valve configured as in FIG. 3. As described above, these two valves provide sampling of piston top land crevice fluid. The two valves cooperate to open and close so that samples can be acquired without significant effect on engine operation. A single sample or a number of samples can be collected, and can be stored or delivered directly to analysis equipment.

What is claimed is:

1. A system for sampling fluid from a top land piston crevice of a reciprocating piston engine, during operation of the engine, for delivery to analysis equipment, comprising:

a tubing having a first end that provides fluid communication into the crevice via a bore through the piston wall;

a piloted check valve whose input end is connected to the second end of the tubing;

a relief valve on the tubing between the crevice and the piloted check valve, operable to open fluid flow from the crevice when a compression pressure of the engine results from a near top dead center position of the piston;

a sample line connected to the output end of the piloted check valve;

a sample container for receiving fluid from the piloted check valve via the sample line;

wherein the piloted check valve is operable to close fluid communication between the crevice and the sample container just prior to a predetermined rise in combustion chamber pressure.

2. The system of claim 1, further comprising a vent line for allowing gas to exhaust from the sample container.

3. The system of claim 2, further comprising a solenoid valve for opening the vent line and a control unit for operating the solenoid valve.

4. The system of claim 1, further comprising a flush line for delivering flush gas into the sample container.

5. The system of claim 1, wherein the piloted check valve receives pilot gas via a solenoid valve and further comprising a control unit for operating the solenoid valve.

6. The system of claim 1, further comprising passages proximate the sample container for providing heat exchange from the sample container.

7. The system of claim 1, further comprising a solenoid valve for opening the exit line and a control unit for operating the solenoid valve.

8. A method of sampling fluid from a piston top land crevice of a reciprocating engine, comprising:

providing a bore into the crevice;

placing a first end of a length of tubing into the bore to provide fluid communication into the crevice;

connecting a second end of the tubing to a piloted check valve;

placing a relief valve in-line the tubing between the crevice and the piloted check valve;

providing a sample line operable to deliver fluid from the piloted check valve to a sample container according to the following operation of the relief valve and the piloted check valve during operation of the engine;

operating the relief valve to open and allow fluid flow from the crevice into the tubing when a compression pressure of the engine results from a near top dead center position of the piston; and operating the piloted check valve to allow fluid flow from the crevice into the sample container except when a pilot pressure provided to the piloted check valve is below a desired pressure; and closing the piloted check valve at a predetermined time prior to peak combustion chamber pressure and at least until the relief valve is closed.

9. The method of claim 8, further comprising repeating both operating steps until a desired number of samples has been collected.

10. The method of claim 8, further comprising venting gas from the sample container.

11. The method of claim 8, further comprising providing a flush line for delivering flush gas into the sample container.

* * * * *